US006510298B1

(12) United States Patent
Kobayashi et al.

(10) Patent No.: US 6,510,298 B1
(45) Date of Patent: Jan. 21, 2003

(54) IMAGE FORMING DEVICE HAVING GROUNDED PHOTORECEPTOR

(75) Inventors: Yukie Kobayashi, Yokohama (JP); Michiteru Oono, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/891,617

(22) Filed: Jun. 27, 2001

(51) Int. Cl.[7] ..... G03G 15/00
(52) U.S. Cl. ..... 399/90; 399/167
(58) Field of Search ..... 399/90, 117, 167, 399/116, 159

(56) References Cited

U.S. PATENT DOCUMENTS 6,035,159 A * 3/2000 Azuma et al. ..... 399/111
6,185,390 B1 * 2/2001 Higeta et al. ..... 399/111
6,266,503 B1 * 7/2001 Murayama et al. ..... 399/117

FOREIGN PATENT DOCUMENTS

JP 07225532 8/1995
JP 09146410 6/1997
JP 10039682 2/1998

* cited by examiner

*Primary Examiner*—Robert Beatty
(74) *Attorney, Agent, or Firm*—Foley & Lardner

(57) ABSTRACT

An image forming device is proposed in which a photoreceptor can be replaced easily, and in which it is unlikely that an image problem is caused by a grounding failure of a photoreceptor. The image forming device includes a driving unit including a first coupling member having a groove or a projection for transmitting a rotating force, the driving unit being made of a conductive material, electrically grounded, and rotatable; and a photoreceptor assembly as a driven section rotated by said driving unit, the photoreceptor assembly including a photoreceptor and a second coupling member, and being attachable to/detachable from said driving unit, the second coupling member having a projection or a groove for engaging with the groove or the projection of the first coupling member, rotation of said driving unit being transmitted to the photoreceptor by the engagement of the first coupling member and the second coupling member. When the photoreceptor is being rotated by the driving unit, the projection or the groove of the second coupling member and the groove or the projection of the first coupling member are electrically connected by pressured contact with each other, thereby grounding said photoreceptor with an electrical resistance value of 1,000 Ω or less.

17 Claims, 6 Drawing Sheets

IMAGE FORMING DEVICE HAVING GROUNDED PHOTORECEPTOR

BACKGROUND OF THE INVENTION

1. Field of the Invention

The present invention relates to image forming devices, and more particularly, to an image forming device in which a photoreceptor can be replaced easily, and in which it is unlikely that an image problem is caused by a grounding failure of a photoreceptor.

2. Related Background Art

An image forming device typically forms a toner image onto the surface of a photoreceptor, and rotates the photoreceptor to transfer the toner image to a printing medium such as paper, thereby forming an image. When the toner image is formed, the photoreceptor undergoes a charging process, an exposing process, and a developing process. Accordingly, it is necessary for the photoreceptor of the image forming device to be grounded.

In a typical configuration of an image forming device, a drum shaft is fixed to the frame (machine frame) of the body of the image forming device, a photoreceptor is rotatably supported by the drum shaft, and a driving gear rotates the photoreceptor. In this configuration, the photoreceptor rotates, while the drum shaft does not rotate. The drum shaft is made of a metal, and grounded. When the drum shaft is fixed to the machine frame, the grounding of the photoreceptor is secured by bringing the drum shaft and the photoreceptor into conduction by the use of an auxiliary member fixed to the drum shaft. However, since such an auxiliary member does not rotate while the photoreceptor rotates, the use of the auxiliary member may cause such problems that harsh frictional noises are made by the friction between the auxiliary member and the photoreceptor, and that the auxiliary member is worn by the friction, eventually leading to a contact failure, thereby resulting in a grounding failure.

In order to solve such problems, it is common for a photoreceptor and a driving shaft to be integrally formed, and a driving gear simultaneously rotates the driving shaft and the photoreceptor. That is, in this structure, the occurrence of grounding failure is avoided by integrally forming the photoreceptor and the driving shaft, the driving shaft made of metal and grounded, and by bringing the photoreceptor and the driving shaft into electrically conduction. However, in such a structure, it is difficult to replace the photoreceptor. That is, the photoreceptor is a consumable, and needs to be replaced at regular intervals, while the driving shaft being fixed to the machine frame together with the driving gear is not expected to be replaced due to deterioration. If the driving shaft and the photoreceptor are affixed to each other, although it is possible to prevent a grounding failure, the photoreceptor cannot be easily removed. Accordingly, users may not be able to replace their photoreceptors on their own. In such a case, the users are forced to ask professionals to replace their photoreceptors, which incurs extra costs such as service fees, etc.

SUMMARY OF THE INVENTION

Given the above-described problems, the present invention is proposed. An object of the present invention is to provide an image forming device in which a photoreceptor can be replaced easily, and in which it is unlikely that an image problem is caused by a grounding failure of a photoreceptor.

According to embodiments of the present invention, there is provided an image forming device comprising: a driving unit including a first coupling member having a groove or a projection for transmitting a rotating force, said driving unit being made of a conductive material, electrically grounded, and rotatable; and a photoreceptor assembly as a driven section rotated by said driving unit, said photoreceptor assembly including a photoreceptor and a second coupling member, and being attachable to/detachable from said driving unit, said second coupling member having a projection or a groove for engaging with said groove or said projection of said first coupling member, rotation of said driving unit being transmitted to said photoreceptor by the engagement of said first coupling member and said second coupling member, and when said photoreceptor is being rotated by said driving unit, said projection or said groove of said second coupling member and said groove or said projection of said first coupling member being electrically connected by a pressured contact with each other, thereby grounding said photoreceptor.

According to embodiments of the present invention, there is further provided an image forming device comprising: a driving shaft which is fixed to a main body of said image forming device, made of a conductive material, electrically grounded, and rotatable; a first coupling member which is made of a conductive elastic material, is fixed to said driving shaft, and has a groove or a projection for transmitting a rotating force; a photoreceptor in a shape of a tube, which is made of a conductive material and is attachable/detachable; and a second coupling member which is made of a conductive elastic material, is fixed to one side of said photoreceptor, and has a projection or a groove that engage with said groove or said projection of said first coupling member, rotation of said driving unit being transmitted to said photoreceptor by the engagement of said first coupling member and said second coupling member, and when said photoreceptor is being rotated, said projection or said groove of said second coupling member and said groove or said projection of said first coupling member being electrically connected by a pressured contact with each other, thereby grounding said photoreceptor.

According to embodiments of the present invention, there is further provided an image forming device comprising: a driving shaft which is fixed to a main body of said image forming device, made of a conductive material, electrically grounded, and rotatable; a first coupling member which is made of a conductive elastic material, is fixed to said driving shaft, and has a groove or a projection for transmitting a rotating force; a cartridge including a photoreceptor, a second coupling member, a developer, and a cleaner unit, said cartridge being integrally attachable/detachable, said photoreceptor being in a shape of a tube and made of a conductive material, said second coupling member being made of a conductive elastic material, being fixed to one side of said photoreceptor, and having a projection or a groove to engage with said groove or said projection of said first coupling member, rotation of said driving unit being transmitted to said photoreceptor by the engagement of said first coupling member and said second coupling member, when said photoreceptor is being rotated, said projection or said groove of said second coupling member and said groove or said projection of said first coupling member being electrically connected by a pressured contact with each other, thereby grounding said photoreceptor, said developer depositing a toner on said photoreceptor so that a latent image becomes a visible image, and said cleaner unit cleaning the toner remaining on said photoreceptor.

DESCRIPTION OF THE PREFERRED EMBODIMENTS

Hereinafter, a first and a second embodiment of the present invention will be described with reference to the accompanying drawings.

(First Embodiment)

Figure 1:
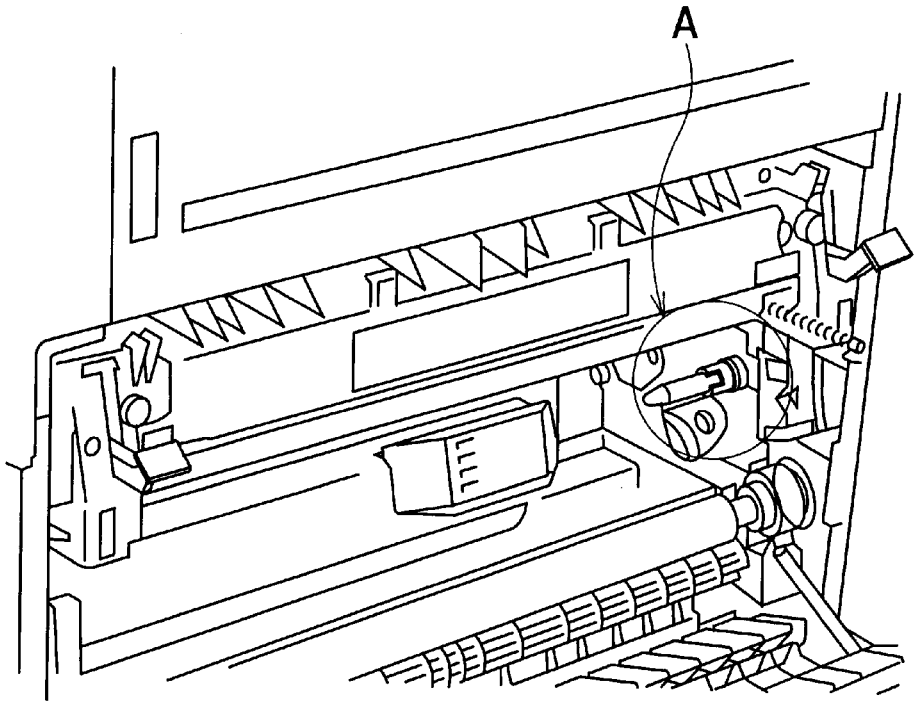
FIG. 1 shows a driving unit of an image forming device according to a first embodiment of the present invention.
Figure 4:
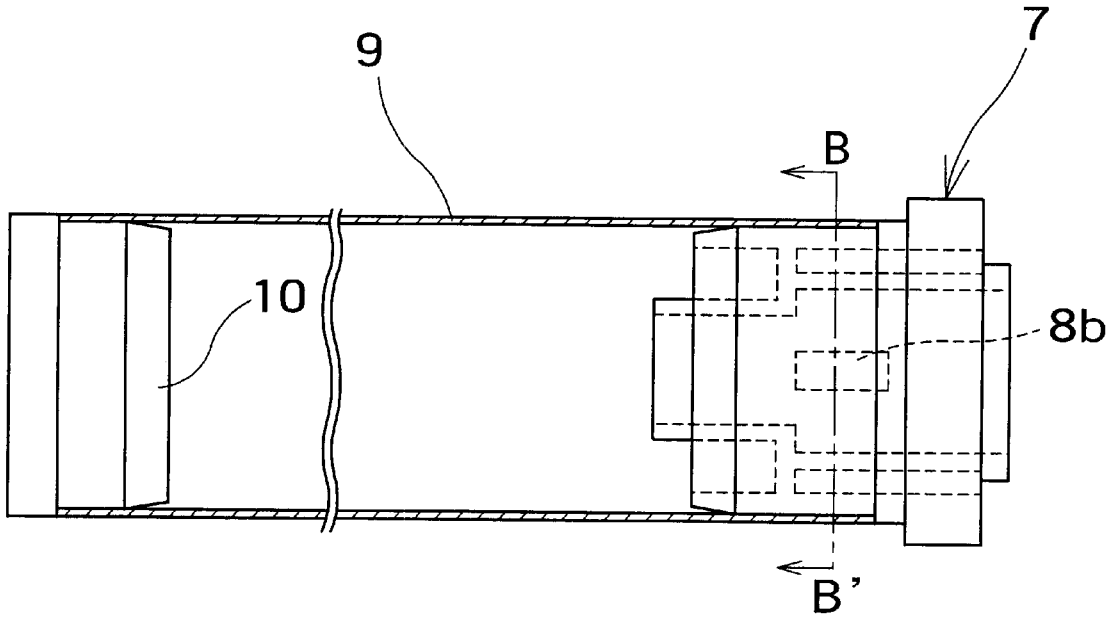
FIG. 4 shows a driven section of the image forming device according to the first embodiment of the present invention.
Figure 6:
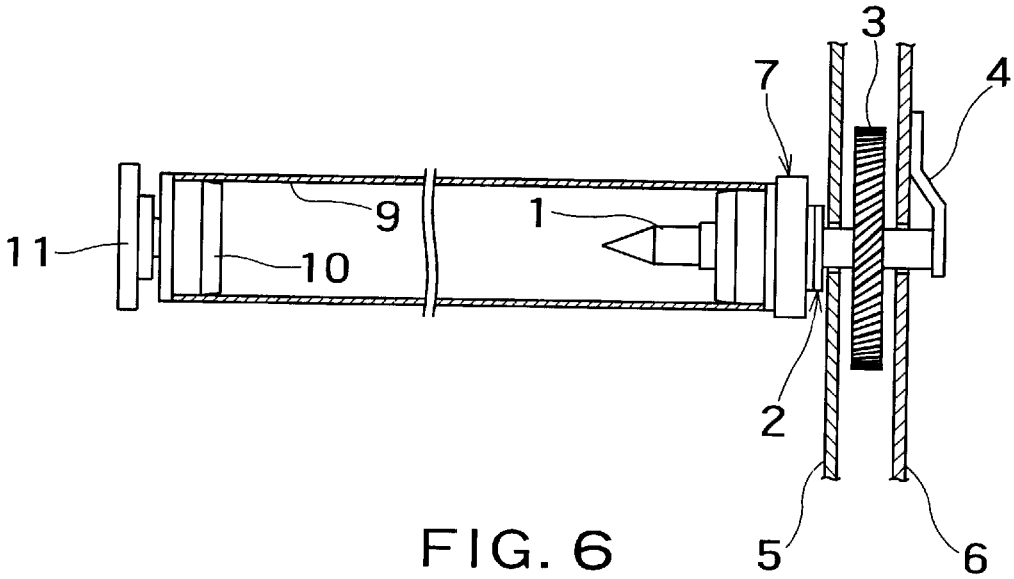
FIG. 6 shows a state in which the driven section is attached to the driving unit of the image forming device according to the first embodiment of the present invention.

FIG. 1 is a perspective view of a driving unit A of an image forming device according to a first embodiment of the present invention. As described later, a photoreceptor assembly as a driven section as shown in FIG. 4 is attached to the driving unit A. The driving unit A and the driven section are used as an assembly as shown in FIG. 6.

Figure 2:
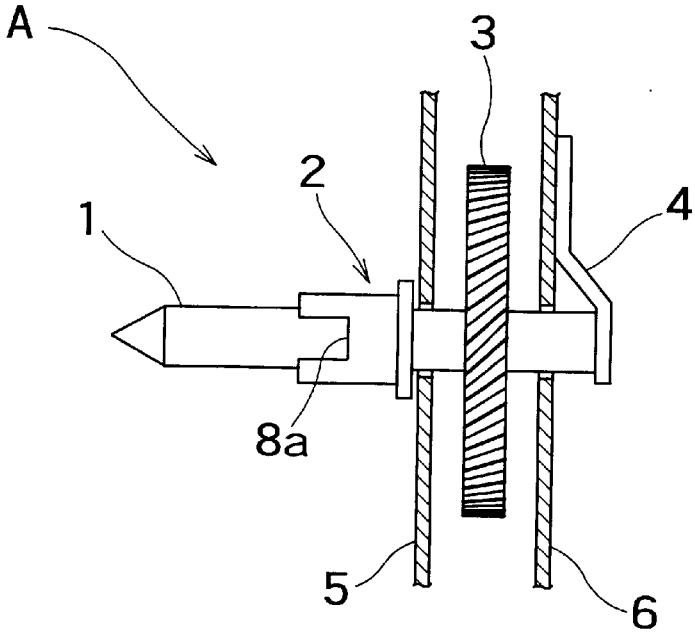
FIG. 2 is an expanded sectional view of the driving unit of the image forming device according to the first embodiment of the present invention.

FIG. 2 is an expanded sectional view of the driving unit A shown in FIG. 1. A driving shaft 1 is fixed to a machine frame 5, and rotated by a driving gear 3 fixed to a main driving gear unit frame 6. The driving shaft 1 is made of a conductive metal, and is grounded by an earth plate 4. The earth plate 4 is a spring member, of which one end is grounded and the other end is pressed to the driving shaft 4 by a spring-loaded force. As understood from FIG. 2, the driving shaft 1 cannot be removed from the machine frame 5. A first coupling member 2, which is made of an elastic conductive resin, is fixed to the driving shaft 1. The first coupling member 2 has grooves 8*a*.

Figure 3:
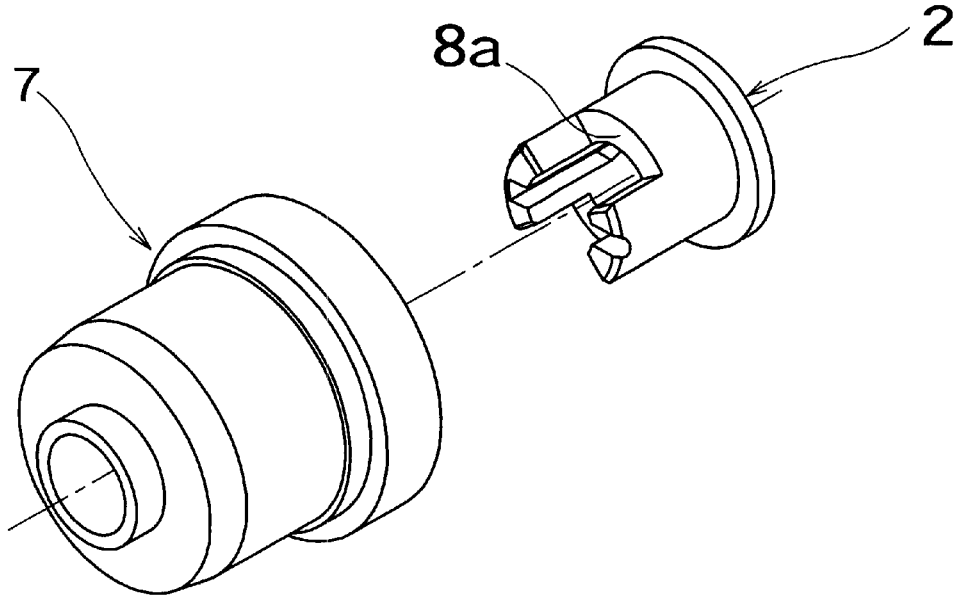
FIG. 3 shows a first coupling member and a second coupling member of the image forming device according to the first embodiment of the present invention.

FIG. 3 is a perspective view of the first coupling member 2. In this embodiment, the first coupling member 2 is made of a resin having a flexural modulus of about 33,000 kg/cm$^2$ and a volume resistivity of about 100 Ω-cm. As described later, the first coupling member 2 is coupled to a second coupling member 7.

FIG. 4 shows a photoreceptor assembly which is attachable to and detachable from the driving unit A of FIG. 1. The photoreceptor assembly of FIG. 4 constitutes a driven section that is rotated by the driving unit of FIG. 1. The photoreceptor assembly includes a photoreceptor 9 and the second coupling member 7. The photoreceptor 9 is of drum type in the shape of a tube. When an image is formed, the photoreceptor 9 is rotated to transfer a toner image as a visible image onto a printing medium such as paper, thereby forming the image. The photoreceptor 9 is a consumable, and is replaced at regular intervals. The second coupling member 7 is fixed to one end of the photoreceptor 9. The second coupling member 7 is made of an elastic conductive resin. In this embodiment, a resin having a flexural modulus of about 67,000 kg/cm$^2$ is used for the second coupling member 7. As shown in FIG. 4, the second coupling member 7 has projections 8*b*, which engage with the grooves 8*a* (FIG. 2) of the first coupling member 2. A resin flange 10 is provided on the other end of the photoreceptor 9.

Figure 5:
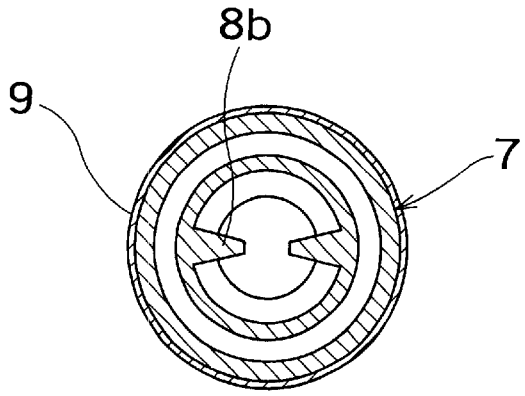
FIG. 5 is a sectional view of the driven section of FIG. 4 taken on line B–B'.

FIG. 5 is a sectional view taken on line B–B' on the second coupling member 7 and the photoreceptor 9 of FIG. 4. As shown in FIG. 5, two projections 8*b* are provided to the second coupling member 7 so as to face to each other. The driving shaft 1 shown in FIG. 2 is inserted into the second coupling member 7 and the photoreceptor 9. At that time, as understood from FIGS. 3 and 5, the second coupling member 7 is coupled with the first coupling member 2, and the projections 8*b* of the second coupling member 7 are engaged with the grooves 8*a* of the first coupling member 2. However, as understood from FIGS. 3 and 5, the width of the projections 8*b* of the second coupling member 7 is narrower than that of the grooves 8*a* of the first coupling member 2. Accordingly, a space is left between a projection 8*b* of the second coupling member 7 and the corresponding groove 8*a* of the first coupling member 2.

FIG. 6 shows a state in which the driving shaft 1 of FIG. 2 is inserted into the photoreceptor assembly of FIG. 4. As mentioned previously, the second coupling member 7 is provided at one end of the photoreceptor 9, and the projections 8*b* (FIG. 5) of the second coupling member 7 engage with the grooves 8*a* (FIG. 3) of the first coupling member 2. This end of the photoreceptor 9 is supported by the driving shaft 1. The other end of the photoreceptor 9 is supported by a drum fixing shaft 11. In the apparatus shown in FIG. 6, the photoreceptor assembly including the photoreceptor 9 and the second coupling member 7 can be easily removed from the driving unit including the driving shaft 1 and the first coupling member 2. The reason for this is that as mentioned previously, there is a space between a projection 8*b* (FIG. 5) of the second coupling member 7 fixed to the photoreceptor 9 and the corresponding groove 8*a* (FIG. 3) of the first coupling member 2 fixed to the driving shaft 1. Thus, in the apparatus shown in FIG. 6, it is easy to replace the photoreceptor 9.

Figure 7:
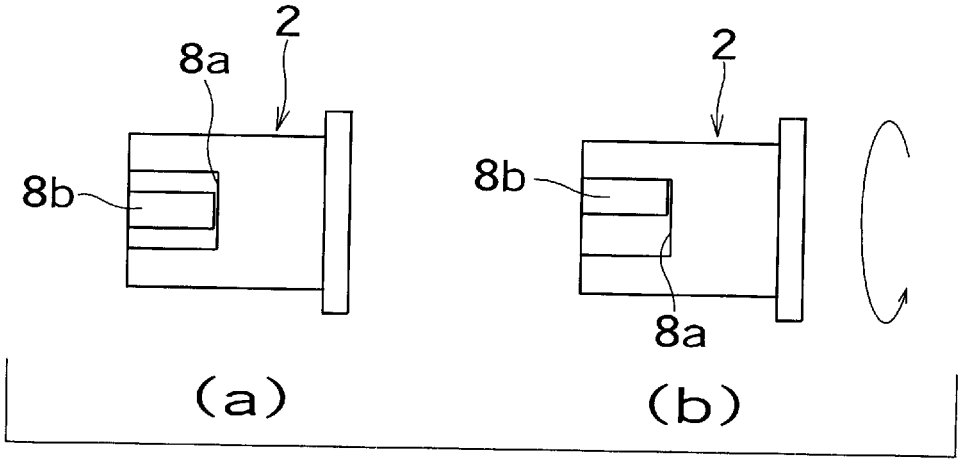
FIGS. 7(*a*) and 7(*b*) show coupling states of the first coupling member and the second coupling member of the image forming device according to the first embodiment of the present invention.

FIGS. 7(*a*) and 7(*b*) show coupling states of the first coupling member 2 and the second coupling member 7 depicted in FIG. 6. As shown in FIG. 7(*a*), when the driving shaft 1 and the first coupling member 2 are not rotating, there is a space between a groove 8*a* of the first coupling member 2 and the corresponding projection 8*b* of the second coupling member 7. However, as shown in FIG. 7(*b*), when the driving shaft 1 and the first coupling member 2 are rotating, one side of the groove 8*a* of the first coupling member 2 securely contacts one side of the projection 8*b* of the second coupling member 7, so that the second coupling member 7 and the photoreceptor 9 are securely grounded.

The process through which the image forming device shown in FIGS. 6 and 7 forms an image onto paper is as follows.

A developer (not shown) deposits a toner on the photoreceptor 9, on the surface of which a latent image is formed by an optical system. As the result, a toner image as a visible image is formed on the surface of the photoreceptor 9. In this state, the state of the grooves 8*a* of the first coupling member 2 and the projections 8*b* of the second coupling member 7 is, e.g., as shown in FIG. 7(*a*).

Then, the driving gear 3 rotates to rotate the driving shaft 1, thereby further rotating the first coupling member 2 fixed to the driving shaft 1. Since the grooves 8*a* of the first coupling member 2 and the projections 8*b* of the second coupling member 7 are coupled as shown in FIG. 7(*b*), a force in the rotating direction is applied from the second coupling member 7 to the photoreceptor 9. As a result, the photoreceptor 9 rotates to transfer the toner image formed thereon to a piece of paper, thereby forming an image.

Next, a cleaner unit (not shown) removes the toner remaining on the surface of the photoreceptor 9.

In the above-described image forming device shown in FIG. 6, the photoreceptor 9 can be easily replaced since the photoreceptor 9 can be easily removed from the driving unit including the driving shaft 1. In addition, as described with reference to FIG. 7(*b*), since the photoreceptor 9 can be securely grounded, no image problem occurs.

That is, as previously mentioned, the photoreceptor 9 must be grounded since a toner image is formed on the photoreceptor 9. If the grounding is insufficient, image problems such as the darkening of the entire copied paper, the incorporation of noises onto copied paper, etc, may occur. The grounding of the photoreceptor 9 should be secured in order to prevent such image problems when an image is formed, i.e., when the photoreceptor 9 is rotated. In the apparatus shown in FIG. 6, the grounding of the photoreceptor 9 is secured by the use of the force in the rotating direction applied at the time of the rotation of the photoreceptor 9. Accordingly, the rotation of the photoreceptor 9 to form an image leads to the securing of the grounding of the photoreceptor 9. Thus, it is possible to prevent the occurrence of image problems.

Furthermore, experiments by the present inventors have revealed that in order to secure the grounding of the photoreceptor 9, it is preferable that materials having proper elasticity are used for the second coupling member 7 and the first coupling member 2. For example, according to the experiments by the present inventors, if a metal is used instead of the second coupling member 7 and the first coupling member 2, although the conductivity of the metal is sufficient, grounding is not sufficiently secured. The reason for this is considered to be that at the time when the above-described force in the rotating direction is applied, in order to secure the contact between the second coupling member 7 and the first coupling member 1, these members should not be too hard, and that these members should have proper elasticity.

Next, the reason why the grounding of the photoreceptor is sufficiently performed and thus image problems can be prevented in the image forming device shown in FIG. 6 will be described with reference to the graphs of FIGS. 8 and 9(*a*) – 9(*c*).

Figure 8:
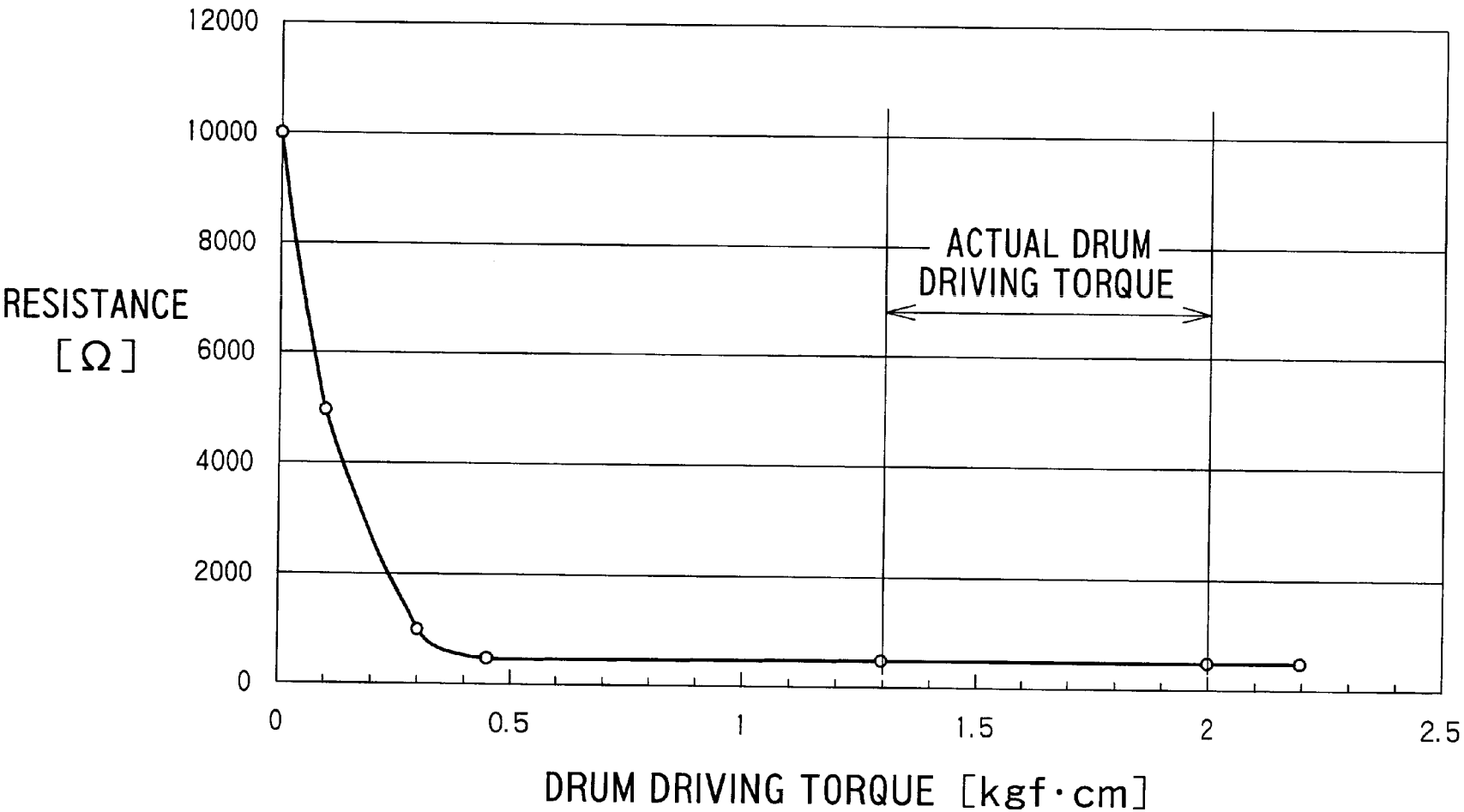
FIG. 8 shows the relationship between the drum driving torque and the resistance value between the first coupling member and the second coupling member of the image forming device according to the first embodiment of the present invention.

FIG. 8 shows the relationship between the force (drum driving torque) applied in the rotating direction of the photoreceptor drum 9 of FIG. 6 and the resistance value between the second coupling member 7 and the first coupling member 2. As shown in FIG. 8, when the photoreceptor drum 9 of FIG. 6 is not rotated, the drum driving torque is 0 kgf-cm, and the resistance value at that time is about 10,000 Ω. Thus, when the photoreceptor drum 9 is not rotated, the resistance value between the second coupling member 7 and the first coupling member 2 is high. However, when the driving shaft starts rotating to increase the drum driving torque, thereby rotating the photoreceptor drum, the above-described resistance value gradually decreases. When the drum driving torque reaches 0.45 kgf-cm or more, the resistance value becomes 500 Ω or less. In the apparatus shown in FIG. 6, the photoreceptor drum 9 rotates at a speed of about 120 mm/s, i.e., about one and half rotations per second. The actual drum driving toque at that time is in the range of 1.3 to 2.0 kgf-cm, as shown in FIG. 8. As understood from FIG. 8, this range is the saturated stable region of the graph curve. Thus, from FIG. 8, it can be understood that when an image is formed, the resistance value between the second coupling member 7 and the first coupling member 2 is 500 Ω or less, and this value is stable.

Figure 9:
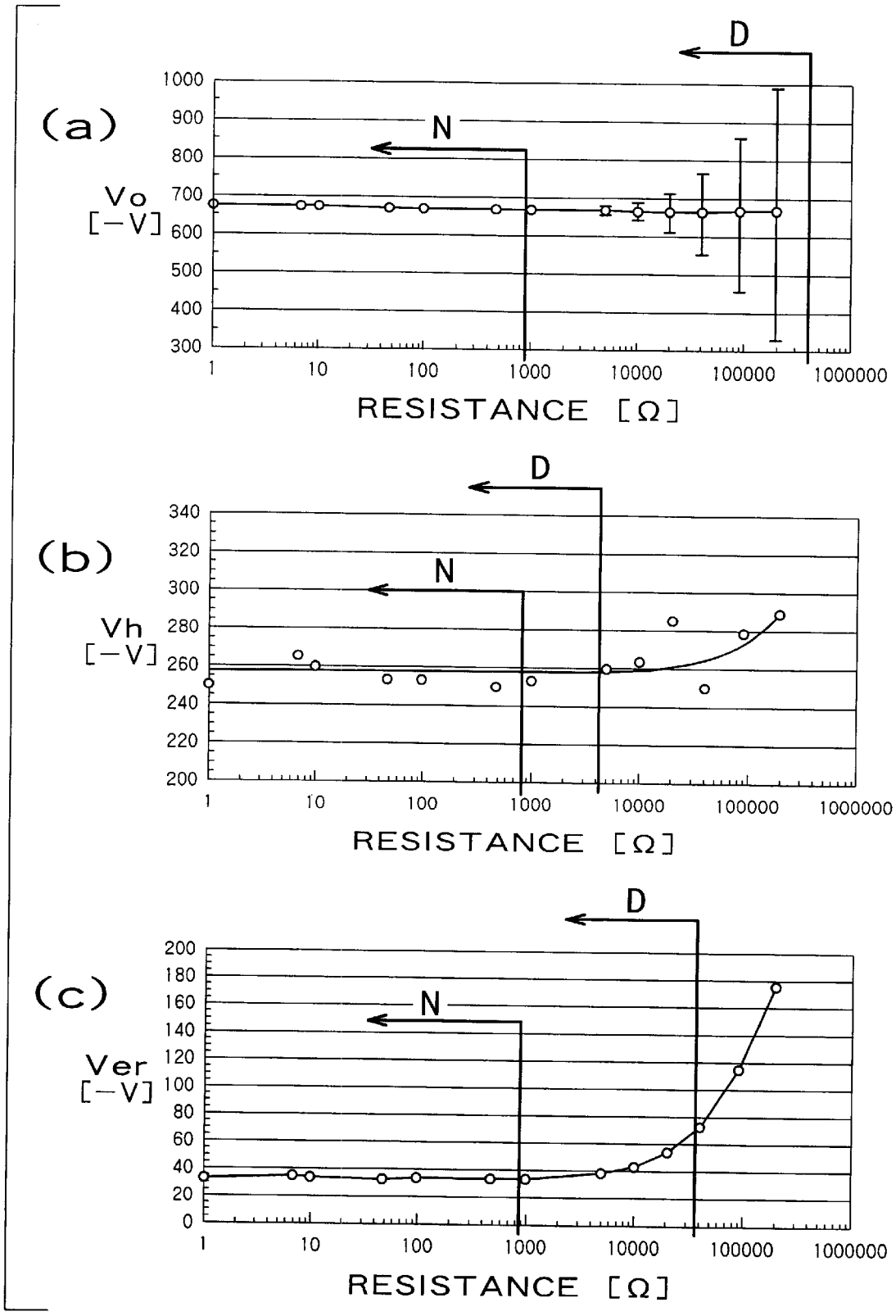
FIGS. 9(*a*)–9(*c*) show the relationships between the resistance value between the first coupling member and the second coupling member and the surface potential of the photoreceptor, the resistance value and inconsistencies in density, and the resistance value and the image noises of the image forming device according to the first embodiment of the present invention.

FIGS. 9(*a*)–9(*c*) show the relationships among the above-described resistance value, the drum surface potential, and the occurrence of image noises. The drum surface potential is the potential of the surface of the drum at the time of forming an image. The surface potential at which a white image is formed is white image potential $V_0$, the surface potential at which a black image is formed is black image potential $V_{er}$, and the potential at which a halftone color image is halftone potential $V_h$. These potentials are minus potentials. Accordingly, on the ordinate axes of FIGS. 9(*a*)–9(*c*), the upper sides represent lower potentials.

FIG. 9(*a*) shows the relationship between the above-described resistance value and the white image potential $V_0$ of the drum. The white dots in the graph represent the set values of the white image potential $V_0$. If the resistance value is relatively high, the white image potential $V_0$ is unstable, and so-called "ripples" appear. The lines extending from the white dots in the vertical direction show the widths of the ripples. Further, the arrow D shows the range in which there is no inconsistency in density, and the arrow N shows the range in which there is no linear image noise. Specifically, if the resistance value is more than 400 k Ω, the width of the ripples markedly increases, so that even if a white image is intended to be formed on paper, the entire tone of the paper becomes darkened, and inconsistencies in density appear. If the resistance value is 400 k Ω or less and more than 1 k Ω, the width of the ripples decreases such that inconsistencies in density disappear. However, when a white image is intended to be formed on paper, linear image noises appear on the paper. If the resistance value is 1 k Ω or less, the above-described image noises disappear.

FIG. 9(*b*) shows the relationship between the resistance value and the halftone voltage $V_h$ of the drum. As is similar to FIG. 9(*a*), the arrow D shows the range in which inconsistencies in density disappear and the arrow N shows the range in which linear image noises disappear. Specifically, if the resistance value is more than 5 k Ω, the halftone voltage becomes too low. Accordingly, when a halftone color image is intended to be formed on paper, inconsistencies in density appear. If the resistance value becomes about 5 k Ω or less, which is within the range shown by the arrow D, although the inconsistencies in density disappear, linear image noises appear. If the resistance value becomes about 1 k Ω or less, which is within the range shown by the arrow N, the image noises disappear.

FIG. 9(*c*) shows the relationship between the resistance value and the black image potential $V_{er}$. As is similar to FIGS. 9(*a*) and 9(*b*), the arrow D in FIG. 9(*c*) shows the range in which inconsistencies in density disappear, and the arrow N shows the range in which linear image noises disappear. Specifically, if the resistance value is more than 40 k Ω, the black image potential becomes too low. Accordingly, when a black image is intended to be formed on paper, inconsistencies in density appear. If the resistance value becomes about 40 k Ω or less, which is within the range shown by the arrow D, although the inconsistencies in density disappear, linear image noises appear. If the resistance value becomes about 1 k Ω or less, which is within the range shown by the arrow N, the image noises disappear.

As understood from FIGS. 9(*a*), 9(*b*), and 9(*c*), in the apparatus shown in FIG. 6, image noises disappear when the resistance value between the second coupling member 7 and the first coupling member 2 becomes 1 k Ω or less.

Turning back to FIG. 8, as mentioned previously, the resistance value at the time of forming an image is 500 or less, and this value is stable. Accordingly, it is possible to securely ground the photoreceptor drum 9 of the image forming device shown in FIG. 6.

Thus, it is understood from the graphs of FIGS. 8 and 9 that in the image forming device according to this embodiment of the present invention, it is easy to replace the photoreceptor 9, and that it is possible to securely ground the photoreceptor 9.

Furthermore, since the photoreceptor 9 and the driving shaft 1 of the image forming device according to this embodiment simultaneously rotate, no harsh frictional sound is generated. Moreover, the second coupling member 7 and the first coupling member 2 are not worn out. Therefore, it is possible to prevent a grounding failure caused by the deterioration of these members.

In addition, since no auxiliary member is required for grounding the photoreceptor drum 9 of the image forming device according to this embodiment, it is not necessary to consider the deterioration of auxiliary members.

As mentioned previously, in the image forming device according to this embodiment of the present invention, the first coupling member 2 has the grooves 8*a* (FIGS. 2 and 3), and the second coupling member 7 has the projections 8*b* (FIGS. 4 and 5), which engage with the grooves 8*a*. However, it is possible that the first coupling member 2 has projections and the second coupling member 7 has grooves, which engage with these projections.

Further, although the first coupling member 2 is placed inside the second coupling member 7, it is possible that the first coupling member 2 may be placed outside the second coupling member 7.

Moreover, although the number of the grooves 8*a* of the first coupling member 2 is two and the number of the projections 8*b* is also two in this embodiment, it is possible to change the numbers of the grooves 8*a* and the projections 8*b* as long as they can be engaged.

In addition, although the first coupling member 2 has the grooves 8*a* in this embodiment, it is possible that portions other than the grooves 8*a* of the first coupling member 2 are shaped as projecting portions, and the projecting portions engage with the projections 8*b* of the second coupling member 7.

(Second Embodiment)

Figure 10:
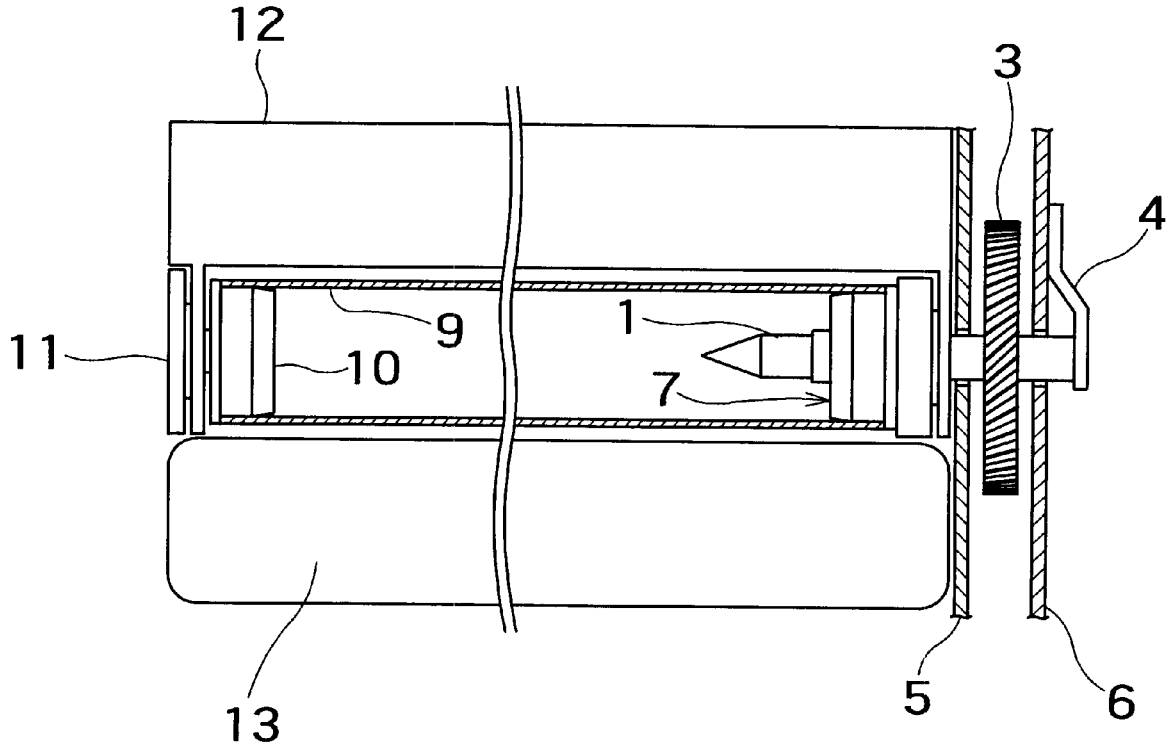
FIG. 10 shows a state in which a driven section is attached to a driving unit of an image forming device according to a second embodiment of the present invention.

FIG. 10 shows a second embodiment of the present invention. As shown in FIG. 10, the second embodiment differs from the first embodiment (FIG. 6) in that a photoreceptor 9 is formed to be integral with a cleaner unit 12 and a developer 13 in a cartridge, which is integrally attachable to the driving unit A (FIGS. 1 and 2). Other portions are the same as those in the first embodiment, and the explanation thereon is omitted. The elements common to those in the first embodiment are assigned the same reference numerals.

In the image forming device shown in FIG. 10, it is easy to replace the cartridge including the photoreceptor 9, and it is possible to securely ground the photoreceptor 9, like the image forming device of the first embodiment (FIG. 6).

Further, in the image forming device shown in FIG. 10, if any of the photoreceptor 9, the cleaner unit 12, and the developer 13 needs replacing, it is not required to specify which one needs replacing. The replacement can be completed by simply replacing the entire cartridge. That is, generally, when the colors on copied paper deteriorates, or image noises appear on copied paper, one, two, or all of the photoreceptor 9, the cleaner unit 12, and the developer 13 may need replacing. However, it takes time to determine which one should be replaced. In the apparatus shown in FIG. 10, however, it is not necessary to specify the part that needs replacing, but the replacement can be completed by simply replacing the entire cartridge.

Moreover, since the photoreceptor 9, the cleaner unit 12, and the developer 13 are integrally formed in the cartridge in the image forming device shown in FIG. 10, displacements of these members rarely happen.

Furthermore, as is similar to the first embodiment, the photoreceptor 9 and the driving shaft 1 of the image forming device according to this embodiment simultaneously rotate. Accordingly, no harsh frictional sound is generated. Moreover, the second coupling member 7 and the first coupling member 2 are not worn out. Therefore, it is possible to prevent a grounding failure caused by the deterioration of these members.

In addition, as is similar to the first embodiment, no auxiliary member is required for grounding the photoreceptor drum 9 of the image forming device according to this embodiment. Accordingly, it is not necessary to consider the deterioration of auxiliary members.

What is claimed is:

1. An image forming device comprising:

a driving unit including a first coupling member having a groove or a projection for transmitting a rotating force, said driving unit being made of a conductive material, electrically grounded, and rotatable; and a photoreceptor assembly as a driven section rotated by said driving unit, said photoreceptor assembly including a photoreceptor and a second coupling member, and being attachable to/detachable from said driving unit, said second coupling member having a projection or a groove for engaging with said groove or said projection of said first coupling member, rotation of said driving unit being transmitted to said photoreceptor by the engagement of said first coupling member and said second coupling member, and when said photoreceptor is being rotated by said driving unit, said projection or said groove of said second coupling member and said groove or said projection of said first coupling member being electrically connected by a pressured contact with each other, thereby grounding said photoreceptor, wherein an electrical resistance value between said first coupling member and said second coupling member at the time said photoreceptor assembly is being rotated by said driving unit is 1,000 Ω or less.

2. The image forming device according to claim 1, wherein said driving unit is electrically grounded by means that one end of a spring member, of which the other end is grounded, is pressured to said rotating driving unit by a spring-loaded force to make a pressured contact.

3. The image forming device according to claim 1, wherein the first coupling member and the second coupling member are formed of an elastic material.

4. The image forming device according to claim 1, wherein said groove or said projection of said first coupling member and said projection or said groove of said second coupling member are engaged, with a space being left therebetween.

5. The image forming device according to claim 1, wherein a force applied from said first coupling member to said second coupling member at the time said photoreceptor assembly is being rotated by said driving unit is 1.3 kgf-cm or more, and 2.0 kgf-cm or less.

6. The image forming device according to claim 1, wherein said photoreceptor assembly constitutes a cartridge, which can be attached to and detached from said driving unit, together with a developer for depositing a toner on said photoreceptor so that a latent image becomes a visible image, and a cleaner unit for cleaning the toner remaining on the photoreceptor.

7. The image forming device according to claim 1, wherein a portion other than said groove of said first coupling member or said second coupling member is shaped as a projecting portion, which is to be engaged with said projection of said second coupling member or said first coupling member.

8. An image forming device comprising:

a driving shaft which is fixed to a main body of said image forming device, made of a conductive material, electrically grounded, and rotatable;

a first coupling member which is made of a conductive elastic material, is fixed to said driving shaft, and has a groove or a projection for transmitting a rotating force;

a photoreceptor in a shape of a tube, which is made of a conductive material and is attachable/detachable; and a second coupling member which is made of a conductive elastic material, is fixed to one side of said photoreceptor, and has a projection or a groove that engage with said groove or said projection of said first coupling member, rotation of said driving shaft being transmitted to said photoreceptor by the engagement of said first coupling member and said second coupling member, and when said photoreceptor is being rotated, said projection or said groove of said second coupling member and said groove or said projection of said first coupling member being electrically connected by a pressured contact with each other, thereby grounding said photoreceptor, wherein an electrical resistance value between said first coupling member and said second coupling member at the time said photoreceptor assembly is being rotated by said driving shaft is 1,000 Ω or less.

9. The image forming device according to claim 8, wherein said driving unit is electrically grounded by means that one end of a spring member, of which the other end is grounded, is pressured to said rotating driving unit by a spring-loaded force to make a pressured contact.

10. The image forming device according to claim 8, wherein said groove or said projection of said first coupling member and said projection or said groove of said second coupling member are engaged, with a space being left therebetween.

11. The image forming device according to claim 8, wherein at the time said photoreceptor is being rotated for forming an image, a force in the rotating direction applied from said first coupling member to said second coupling member is 1.3 kgf-cm or more, and 2.0 kgf-cm or less.

12. The image forming device according to claim 8, wherein a portion other than said groove of said first coupling member or said second coupling member is shaped as a projecting portion, which is to be engaged with said projection of said second coupling member or said first coupling member.

13. An image forming device comprising:

a driving shaft which is fixed to a main body of said image forming device, made of a conductive material, electrically grounded, and rotatable;

a first coupling member which is made of a conductive elastic material, is fixed to said driving shaft, and has a groove or a projection for transmitting a rotating force; and a cartridge including a photoreceptor, a second coupling member, a developer, and a cleaner unit, said cartridge being integrally attachable/detachable, said photoreceptor being in a shape of a tube and made of a conductive material, said second coupling member being made of a conductive elastic material, being fixed to one side of said photoreceptor, and having a projection or a groove to engage with said groove or said projection of said first coupling member, rotation of said driving shaft being transmitted to said photoreceptor by the engagement of said first coupling member and said second coupling member, when said photoreceptor is being rotated, said projection or said groove of said second coupling member and said groove or said projection of said first coupling member being electrically connected by a pressured contact with each other, thereby grounding said photoreceptor, said developer depositing a toner on said photoreceptor so that a latent image becomes a visible image, and said cleaner unit cleaning the toner remaining on said photoreceptor, wherein an electrical resistance value between said first coupling member and said second coupling member at the time said photoreceptor assembly is being rotated by said driving shaft is 1,000 Ω or less.

14. The image forming device according to claim 13, wherein said driving unit is electrically grounded by means that one end of a spring member, of which the other end is grounded, is pressured to said rotating driving unit by a spring-loaded force to make a pressured contact.

15. The image forming device according to claim 13, wherein said groove or said projection of said first coupling member and said projection or said groove of said second coupling member are engaged, with a space being left therebetween.

16. The image forming device according to claim 13, wherein at the time said photoreceptor is being rotated for forming an image, a force in the rotating direction applied from said first coupling member to said second coupling member is 1.3 kgf-cm or more, and 2.0 kgf-cm or less.

17. The image forming device according to claim 13, wherein a portion other than said groove of said first coupling member or said second coupling member is shaped as a projecting portion, which is to be engaged with said projection of said second coupling member or said first coupling member.

* * * * *